US007999758B2

(12) United States Patent
Bae et al.

(10) Patent No.: US 7,999,758 B2
(45) Date of Patent: Aug. 16, 2011

(54) BROADBAND ANTENNA

(75) Inventors: Seok Bae, Gyunngi-do (KR); In Young Kim, Gyunggi-do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 384 days.

(21) Appl. No.: 11/867,301

(22) Filed: Oct. 4, 2007

(65) Prior Publication Data

US 2008/0100525 A1 May 1, 2008

(30) Foreign Application Priority Data

Oct. 26, 2006 (KR) ..... 10-2006-0104602

(51) Int. Cl.
*H01Q 1/36* (2006.01)

(52) U.S. Cl. ..... 343/895; 343/700 MS

(58) Field of Classification Search ..... 343/700, 343/702, 795, 806, 787, 895
See application file for complete search history.

(56) References Cited

U.S. PATENT DOCUMENTS

| | | | | |
|---|---|---|---|---|
| 6,987,483 | B2 * | 1/2006 | Tran | 343/700 MS |
| 7,292,198 | B2 * | 11/2007 | Shtrom et al. | 343/795 |
| 7,324,063 | B2 * | 1/2008 | Bae et al. | 343/895 |
| 7,345,650 | B2 * | 3/2008 | Bae et al. | 343/895 |

* cited by examiner

*Primary Examiner* — Jacob Y Choi
*Assistant Examiner* — Kyana R Robinson
(74) *Attorney, Agent, or Firm* — Lowe, Hauptman, Ham & Berner, LLP

(57) ABSTRACT

A broadband antenna including: a dielectric substrate; a meander line radiator formed on the dielectric substrate to be bent at an acute angle; and a stub extended from at least one of bending portions of the meander line radiator, wherein the meander line radiator has 2n number of the bending portions thereon to form an n number of turns, where n≧1.

19 Claims, 6 Drawing Sheets

BROADBAND ANTENNA

CROSS-REFERENCE TO RELATED APPLICATIONS

This application claims the priority of Korean Patent Application No. 2006-104602 filed on Oct. 26, 2006, in the Korean Intellectual Property Office, the disclosure of which is incorporated herein by reference.

BACKGROUND OF THE INVENTION

1. Field of the Invention

The present invention relates to a broadband antenna, and more particularly, to an antenna in which a stub is extended from bending portions of a meander line radiator formed at an acute angle to achieve broadband characteristics and the number of turns of the meander line radiator is adjusted to tune antenna characteristics.

2. Description of the Related Art

Antennas in recent use for mobile phones have seen diversity in usable frequency bands thereof due to advancement in wireless technology. Specific examples adopting a variety of usable frequency bands include antennas for use in global system for mobile communications (GSM), and code division multiple access (CDMA) mobile phones (800 MHz to 2 GHz), wireless local area network (LAN) (2.4 GHz, 5 GHz), contactless radio frequency identification (RFID) (13.56 MHz, 433.92 MHz, 908 to 914 MHz, 2.45 GHz), Bluetooth (2.4 GHz), global positioning system (GPS) (1.575 GHz), FM radio (88 to 108 MHz), TV broadcasting (470 to 770 MHz), ultra-wideband (UWB), and Zigbee. Other notable examples include antennas for use in digital multimedia broadcasting (DMB) including a satellite DMB (2630 to 2655 MHz) and a terrestrial DMB (174 to 216 MHz), which has been commercially available since 2005 and, and Nokia's DVB-H broadcasting (475 to 750 MHz) which has been commercially viable since June 2006.

To accommodate these broad bandwidths and multiple telecommunication channels, a wireless device is internally equipped with a plurality of antennas. The wireless device having the antennas installed therein as described above is rendered complicated and increased in size and manufacturing costs thereof.

A general antenna beneficially operating in a multi-band is a planar inverse F-type antenna (PIFA). This antenna assures signals to be received at different frequencies, thereby operating in multiple bands. However, the signals are hardly received in neighboring frequency bands.

Conventionally, an inverted F-type antenna, a helical antenna and an antenna utilizing a high dielectric substrate are employed to develop an antenna device having a size of 10 mm×10 mm at a frequency of at least 1 GHz. However, at a lower frequency band, i.e., a very high frequency (VHF) of up to hundreds of MHz like a terrestrial DMB, a ½ wavelength antenna and a ¼ wavelength antenna are lengthened to tens of cm, thus hardly installed in the mobile phones.

SUMMARY OF THE INVENTION

An aspect of the present invention provides a broadband monopol antenna in which a stub is formed on a meander line radiator, and a magnetic dielectric composite material is utilized to reduce size of the antenna and achieve broadband characteristics.

According to an aspect of the present invention, there is provided a broadband antenna including: a dielectric substrate; a meander line radiator formed on the dielectric substrate to be bent at an acute angle; and a stub extended from at least one of bending portions of the meander line radiator, wherein the meander line radiator has 2n number of the bending portions thereon to form an n number of turns, where $n \geqq 1$.

The meander line radiator may have two bending portions formed at an identical acute angle in each of the turns. The meander line radiator may have the bending portions formed at a greater acute angle with increase in the number of the turns.

The meander line radiator may have parallel lines disposed at an equal interval so as to have bending portions formed at an identical angle.

The broadband antenna may further include a stub formed at another end of the meander line radiator provided at one end thereof with a feeder.

The bending portions may have respective stubs extended therefrom, and the stubs are oriented in an identical direction. The stubs may be formed in parallel with a length direction of the meander line radiator.

The broadband antenna may further include a dielectric layer covering the meander line radiator.

The dielectric substrate may be formed of a composite material having a magnetic material and a polymer resin mixed together. The magnetic material may be selected from one of carbonyl iron, nickel-zinc ferrite powder, and Z-type ferrite powder.

The broadband antenna may further include at least one radiator connected to an identical feeder where the meander line radiator is connected. The at least one radiator may be a meander line radiator bent at the acute angle and having a stub extended from at least one of bending portions. The meander line radiator may include a plurality of meander line radiators having a different number of turns from one another.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
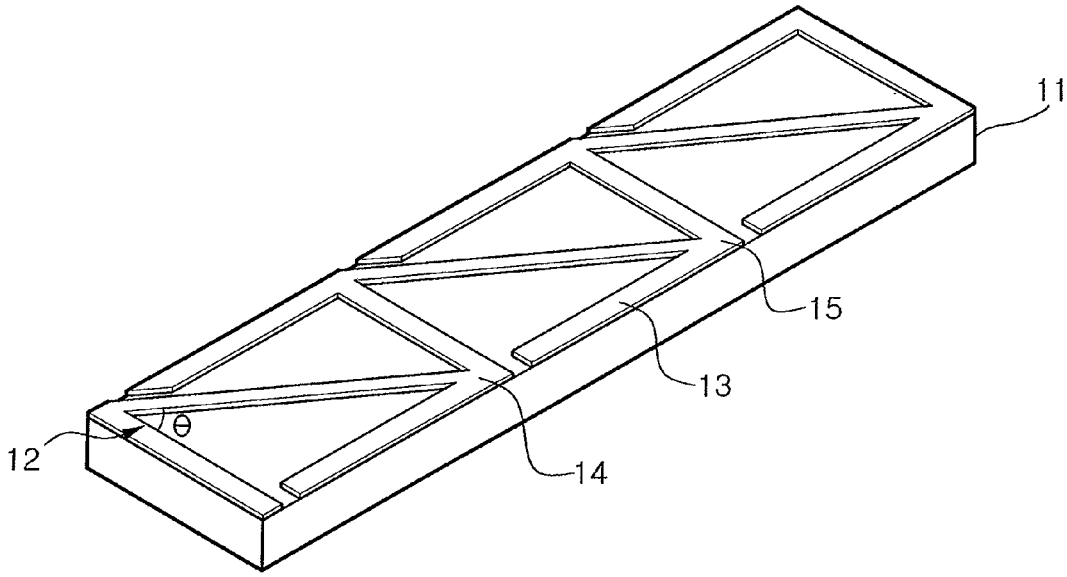
FIG. 1 is a perspective view illustrating a broadband antenna according to an exemplary embodiment of the invention.

FIG. 1 is a perspective view illustrating a broadband antenna according to an exemplary embodiment of the invention.

The broadband antenna of the present embodiment includes a dielectric substrate 11, a meander line radiator 12, and a stub 13.

The meander line radiator 12 is formed on a top of the dielectric substrate 11.

The meander line radiator 12 may be formed of a conductive paste such as silver Ag and copper Cu.

The meander line radiator 12 of the present embodiment has bending portions formed at an acute angle to define a meander line.

The meander line with the bending portions formed at an acute angle θ prevents magnetic fields generated by a current flowing through the meander line radiator 12 from being cancelled out each other, while improving broadband characteristics of the antenna. That is, the radiator is beneficially increased in length, thereby transmitting and receiving signals in a low frequency band.

The meander line radiator formed on the dielectric substrate 11 may be shaped variously. That is, the meander line may be increased in the number of turns, with the dielectric substrate sized identical and also adjusted in width thereof.

With such adjustment in width and the number of turns, antenna characteristics can be controlled.

In the present embodiment, a plurality of parallel lines constituting the meander line radiator 12 are disposed at an equal interval and radially connected in an identical direction. Accordingly, the meander line radiator has the bending portions formed at an identical acute angle.

Also, the meander line radiator of the present embodiment has six bending portions to form three turns.

A stub 13 is extended from each of the bending portions of the meander line radiator 12.

The stub 13 is extended from each of the bending portions formed on the meander line radiator 12 toward the adjacent bending portion. That is, the stub 13 formed in one 15 of the bending portions is disposed close to the adjacent bending portion 14, however not connected thereto.

This stub 13 allows a current flowing through the meander line radiator 12 to flow therethrough. The current flowing through the stub 14 is matched with a current flowing through the adjacent bending portion 14 to alter antenna characteristics.

That is, frequency characteristics of the antenna can be controlled by adjusting a length of the stub formed on the bending portion.

Figure 5A:
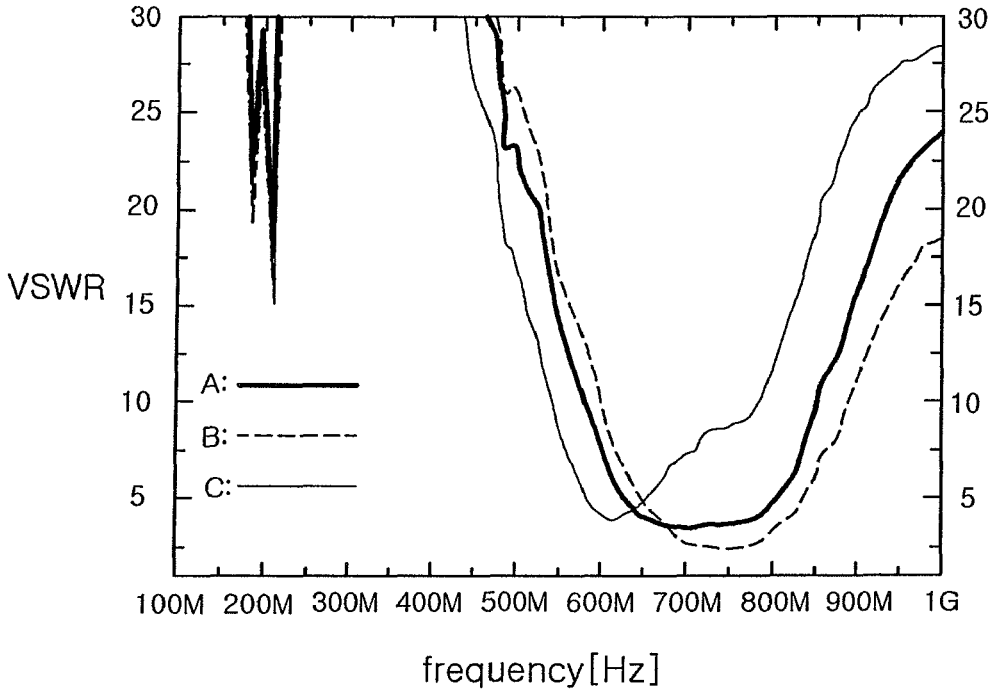
FIGS. 5A and 5B are graphs illustrating voltage standing wave ratios (VSWRs) and gains which are varied with a change in the number of turns of a meander line radiator according to an exemplary embodiment of the invention.
Figure 5B:
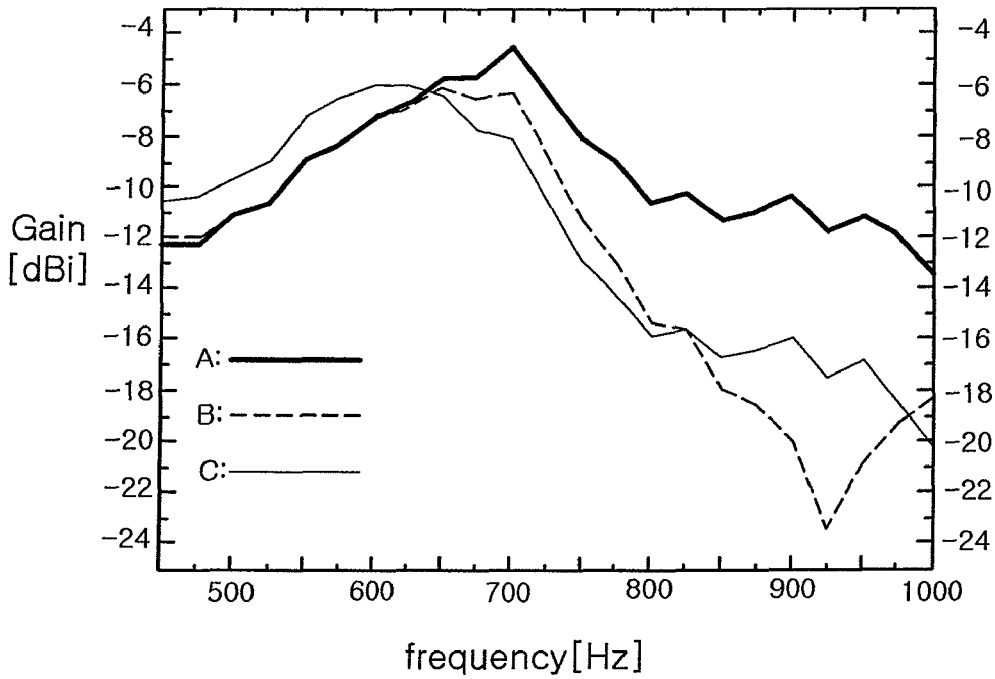

FIGS. 5A and 5B illustrate voltage standing wave ratios (VSWRs) and gains which are varied with a change in the number of turns of meander line radiators of antennas.

Here, magnetic dielectric composite devices each having a permittivity of 5.5 and a permeability of 1.2 were adopted as dielectric substrates. Each of the magnetic dielectric composite devices was shaped as a block having a size of 10×40×20 mm. The meander line radiators formed on the respective dielectric substrates each had a width of 1 mm but differed in the number of turns, with 2 in the antenna A, 5 in the antenna B, and 10 in the antenna C, respectively.

Referring to FIG. 5A, each of the antennas exhibits a frequency bandwidth of at least 100 MHz at a VSWR of 3, thus operating in abroad band. These broadband characteristics are attributed to permittivity and permeability of the magnetic dielectric composite devices and a configuration of the meander line radiators having stubs extended from the bending portions.

Also, with the number of turns increasing from 2 to 10, a resonance frequency is lowered. That is, the antenna having the meander line radiator with two turns has a resonance frequency of about 750 MHz, the antenna having the meander line radiator with five turns has a resonance frequency about 700 MHz, and the antenna having the meander line radiator with ten turns has a resonance frequency of about 600 MHz. This results from increase in inductance and capacitance generated around the meander line radiator.

Referring to FIG. 5B, with increase in the number of turns of the meander line radiators, each of the antennas is gradually increased in gain at a low frequency band of 700 MHz or less. On the contrary, with decrease in the number of turns, each of the antennas is increased in gain at a frequency band of at least 700 MHz.

The number of turns of the meander line radiator can be adjusted to enhance frequency characteristics of the antenna at a low frequency band of 700 MHz or less. This accordingly produces a small broadband antenna capable of transmitting and receiving signals at a frequency band of 475 to 750 MHz for use in a DVB-H broadcasting.

As described above, in the antenna of the present embodiment, the meander line radiator is adjusted in the number of turns to tune antenna characteristics.

The dielectric substrate 11 may be formed of a magnetic dielectric composite material having a magnetic substrate and a polymer resin mixed together.

Conventionally, an antenna has adopted a conductor with a ½ or ¼ length of a free space wavelength. A representative example includes a metal rod antenna or an antenna having a conductor coated with a non-insulating material.

Compared with these antennas, a chip antenna or a patch antenna utilizing a dielectric material may be reduced in size according to following Equation:

$$\frac{\lambda}{\lambda_0} = \frac{1}{\sqrt{\varepsilon}}$$

where $\lambda$ is an actual wavelength, $\lambda_0$ is a wavelength of a free space, and $\epsilon$ is a dielectric constant.

That is, higher permittivity leads to a smaller size of the antenna, but a narrower bandwidth at the same time, rendering the antenna unlikely to be commercially viable. Therefore, the antenna is chiefly formed of a material having a permittivity of 5 to 10.

A representative material for this dielectric material includes glass ceramics with a permittivity of 4 to 7. Thus, the glass ceramics can be co-fired at a relatively low temperature together with a conductive pattern mainly formed of silver Ag or palladium Pd, thus significantly used in a mobile chip antenna.

The antenna using a magnetic material has been conventionally utilized in an amplitude modulation (AM) radio broadcasting covering a medium frequency (MF) band of 300 kHz to 3 MHz. The conventional magnetic material is degraded in magnetic properties at a frequency band higher than the MF due to resonance thereof. Therefore, to manufacture an antenna using the magnetic material at a very high frequency (VHF) band or ultra high frequency (UHF) band, a low-loss material should be essentially developed. The material with such characteristics includes Z-type hexagonal ferrite, i.e., soft magnetic ferrite, Ni—Zn-based ferrite having a permeability regulated to be as low as 20 or less and carbonyl iron.

A resonance length, which is the fundamental factor in reducing size of the antenna, satisfies following Equation:

$$\frac{\lambda}{\lambda_0} = \frac{1}{\sqrt{\varepsilon \times \mu}}$$

where $\lambda$ is an actual wavelength, $\lambda_0$ is a wavelength of a free space, $\epsilon$ is a dielectric constant, and $\mu$ is permeability. Therefore, when the substrate is formed of a material having permittivity and permeability satisfying the Equation above, a resonance length is decreased at a much greater rate than when a substrate with a high permittivity (permeability 1) is adopted. This reduces a length of an antenna line, beneficially leading to a smaller size of a mobile terminal.

Particularly, while glass ceramics currently in great use for a portable terminal antenna have a permittivity of 1 to 6, the ferrite material has a permeability of 1 to 20 and a permittivity of 5 to 20. The substrate formed of the glass ceramics and ferrite material allows electromagnetic waves to propagate at a much slower rate and, accordingly, a wavelength to be lengthened, thereby realizing a more compact antenna easily.

Moreover, higher permittivity of the dielectric material advantageously shortens a resonance length but disadvantageously narrows bandwidth of the antenna. On the other hand, higher permeability of the magnetic material has insignificant effects on usable bandwidth.

The present embodiment employs a magnetic dielectric composite material having carbonyl iron, i.e., a magnetic material, and a silicon resin mixed together to overcome problems with a conventional technology.

Figure 6A:
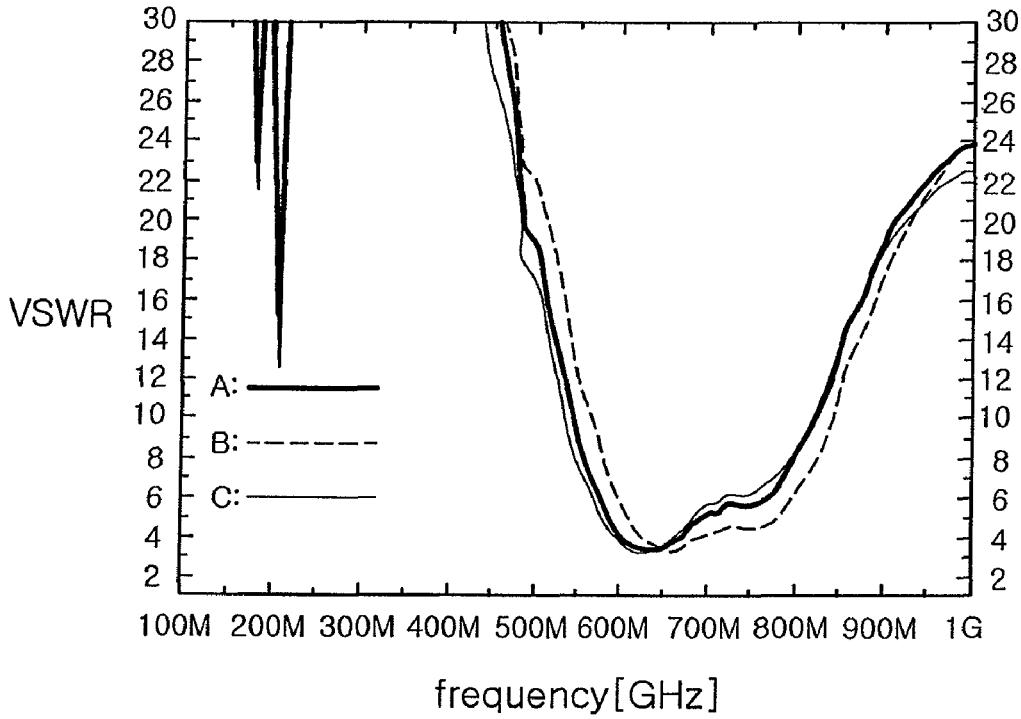
FIGS. 6A and 6B are graphs illustrating VSWRs and gains which are varied with a change in permittivity and permeability of a magnetic dielectric composite material according to an exemplary embodiment of the invention.
Figure 6B:
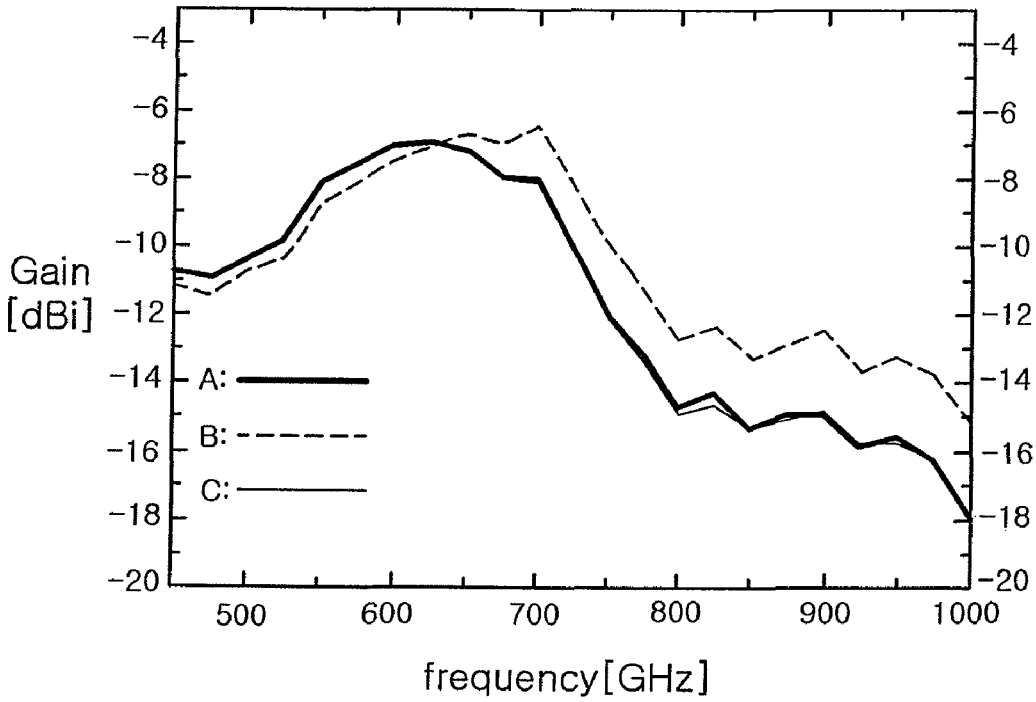

FIGS. 6A and 6B are graphs illustrating antenna characteristics changing according to a change in permittivity and permeability of the magnetic dielectric composite materials utilized for antennas.

The magnetic dielectric composite materials each were shaped as a block with a size of 10×40×2 mm. Meander line radiators formed on the dielectric composite materials had a width of 1 mm and 8 turns. The magnetic material mixed in the magnetic dielectric composite material adopted carbonyl iron.

FIGS. 6A and 6B illustrate VSWRs and gains according to frequencies. The antenna A was formed of carbonyl iron and a silicon resin mixed at a ratio of 1:1, the antenna B was formed of carbonyl iron and a silicon resn mixed at a ratio of 2:1 and the antenna C was formed of carbonyl iron and a silicon resin mixed at a ratio of 3:1.

A mixing ratio between the carbonyl iron and the silicon resin was varied to change permittivity and permeability of the magnetic dielectric composite material. According to detailed experimental results, the antenna A had a permeability of 4.8 and a permittivity of 1.6, the antenna B had a permeability of 6.5 and a permittivity of 2.1, and the antenna C had a permeability of 8 and a permittivity of 2.8.

A change in permittivity and permeability brings about a change in antenna characteristics, and thus a greater mixing ratio of the magnetic material, which means higher permittivity and permeability, lowers a resonance frequency and reduces bandwidth of the antenna.

Therefore, a broadband antenna can be obtained by adjusting permittivity and permeability. Each of the antennas is gradually increased in gain at a low frequency of 700 MHz or less.

Figure 2:
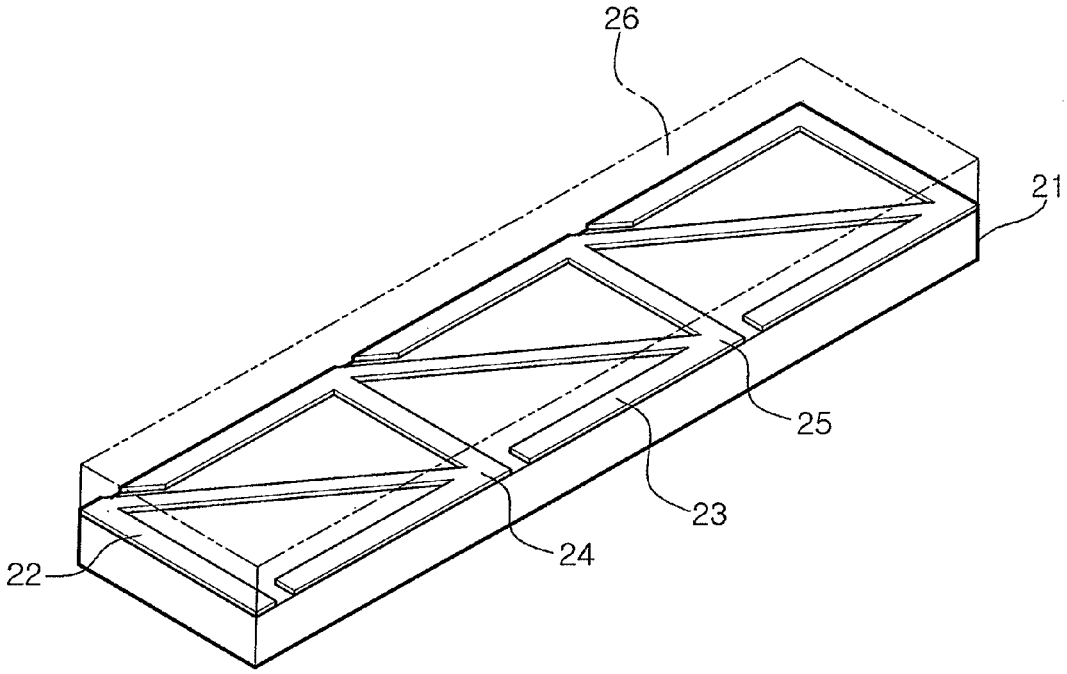
FIG. 2 is a perspective view illustrating a broadband antenna according to an exemplary embodiment of the invention.

FIG. 2 is a perspective view illustrating a broadband antenna according to an exemplary embodiment of the invention.

Referring to FIG. 2, the broadband antenna of the present embodiment includes a meander line radiator 22 having stubs 23 extended therefrom and dielectric substrates 21 and 26 overlying and underlying the radiator.

In the antenna of the present embodiment, a meander line radiator 22 is formed between the dielectric substrates. To manufacture the dielectric substrates 21 and 26, dielectric substrates having permittivity and permeability different from each other may be bonded together and co-fired. Also, the dielectric substrates 21 and 26 may have permittivity and permeability identical to each other.

As described above, the meander line radiator 12 is formed between the dielectric substrates 21 and 26, thereby altering antenna characteristics according to permittivity and permeability of the dielectric substrates 21 and 26.

Figure 3A:
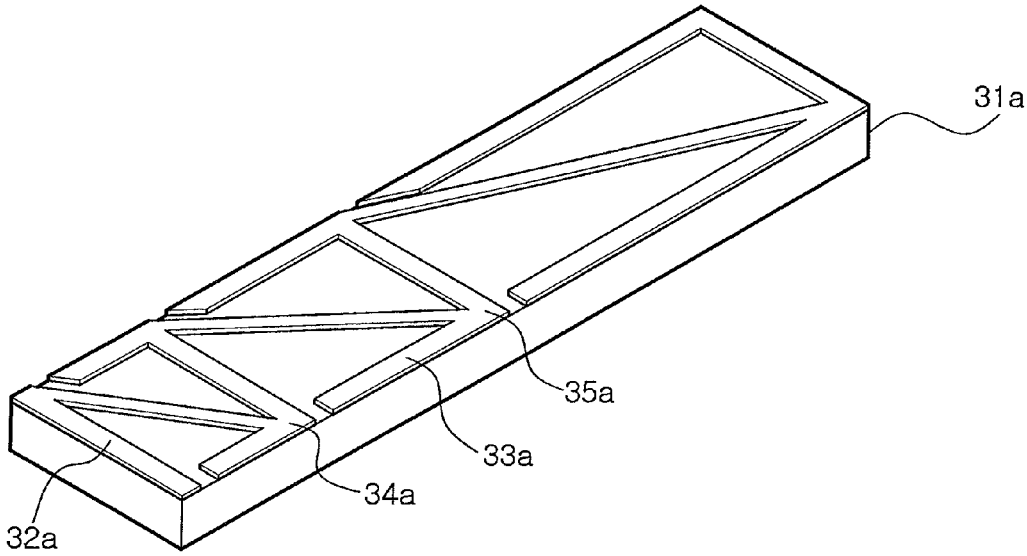
FIGS. 3A and 3B are perspective views illustrating broadband antennas, respectively, according to an exemplary embodiment of the invention.
Figure 3B:
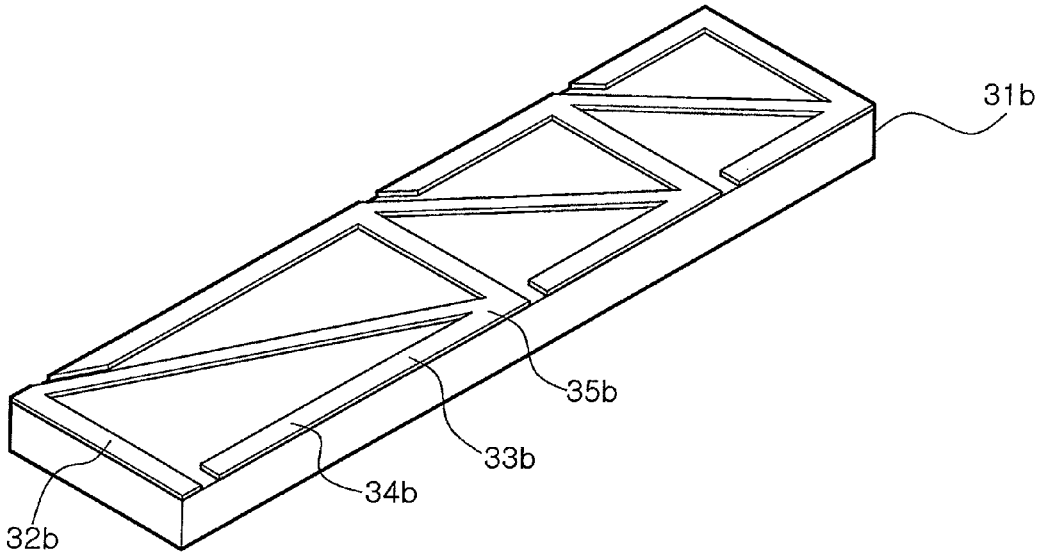

FIGS. 3A and 3B are perspective views illustrating broadband antennas, respectively, according to an exemplary embodiment of the invention.

Referring to FIG. 3A, the meander line radiator 32*a* formed on the dielectric substrate 31*a* has parallel lines disposed at a gradually greater interval so that bending portions are formed at a greater acute angle with increase in the number of turns. Referring to FIG. 3B, the meander line radiator 32*b* has parallel lines disposed at a gradually short interval so that bending portions are formed at a smaller acute angle with increase in the number of turns.

The parallel lines of the meander line radiator disposed at a greater or shorter interval allow the bending portions to be formed at a different acute angle and stubs to be extended in a different length from the bending portions. This accordingly changes inductance and capacitance generated by currents flowing through the meander line and the stubs.

Figure 4:
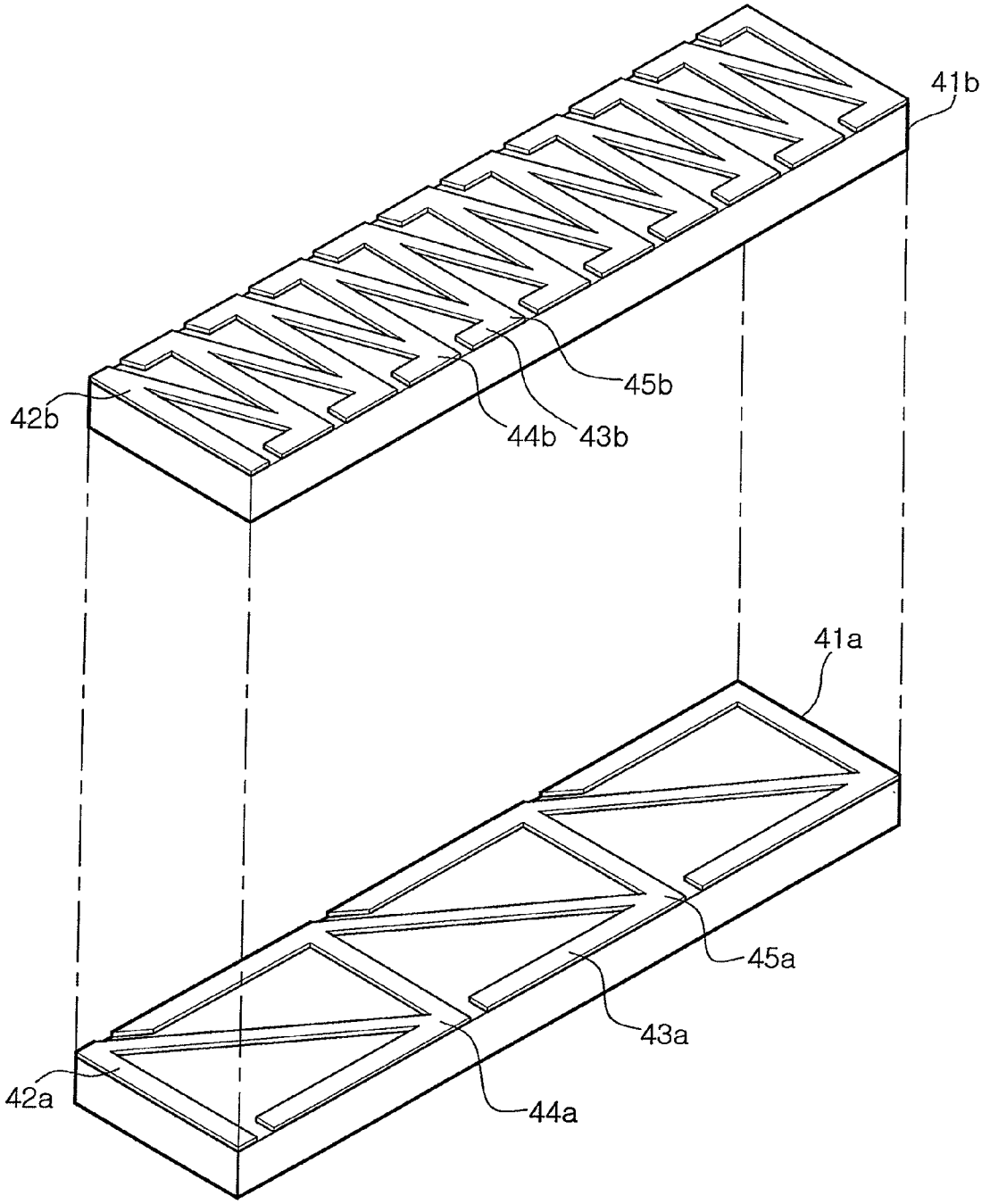
FIG. 4 is an exploded perspective view illustrating a broadband antenna according to an exemplary embodiment of the invention.

FIG. 4 is an exploded perspective view illustrating a broadband antenna according to an exemplary embodiment of the invention.

Referring to FIG. 4, a meander line radiator 42*a* is formed at an acute angle on a top of a dielectric substrate 41*a* and a stub 43*a* is extended from each of bending portions of the meander line radiator toward an adjacent bending portion.

On the meander line radiator 42*a* is deposited a dielectric substrate 42*b* having a meander line radiator 42*b* formed to have a different number of turns from the meander line radiator 42. That is, the underlying meander line radiator 42*a* has 3 turns and the overlying meander line radiator 42*b* has 10 turns.

The meander line radiators 42*a* and 42*b* with different numbers of turns each have one end connected to an identical feeder to receive a signal.

As described above, the meander line radiators with different numbers of turns are connected to the identical feeder, thereby producing an antenna capable of transmitting and receiving signals at different frequency bands. As shown in FIG. 5B, a greater number of turns increases gain with respect to a low frequency band and a smaller number of turns increase gain with respect to a high frequency band. Thus, the antenna of the present embodiment provides a broadband antenna which assures high gain with respect to a low frequency and high frequency.

Figure 7A:
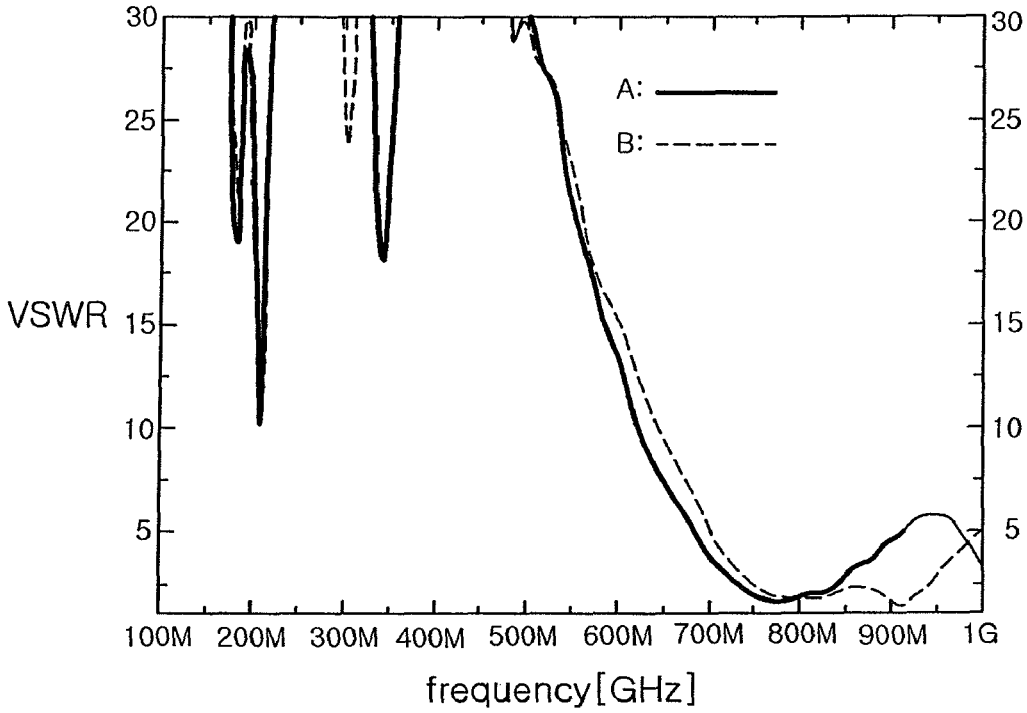
FIGS. 7A and 7B are graphs illustrating VSWRs and gains of the antenna according to the embodiment of FIG. 4.
Figure 7B:
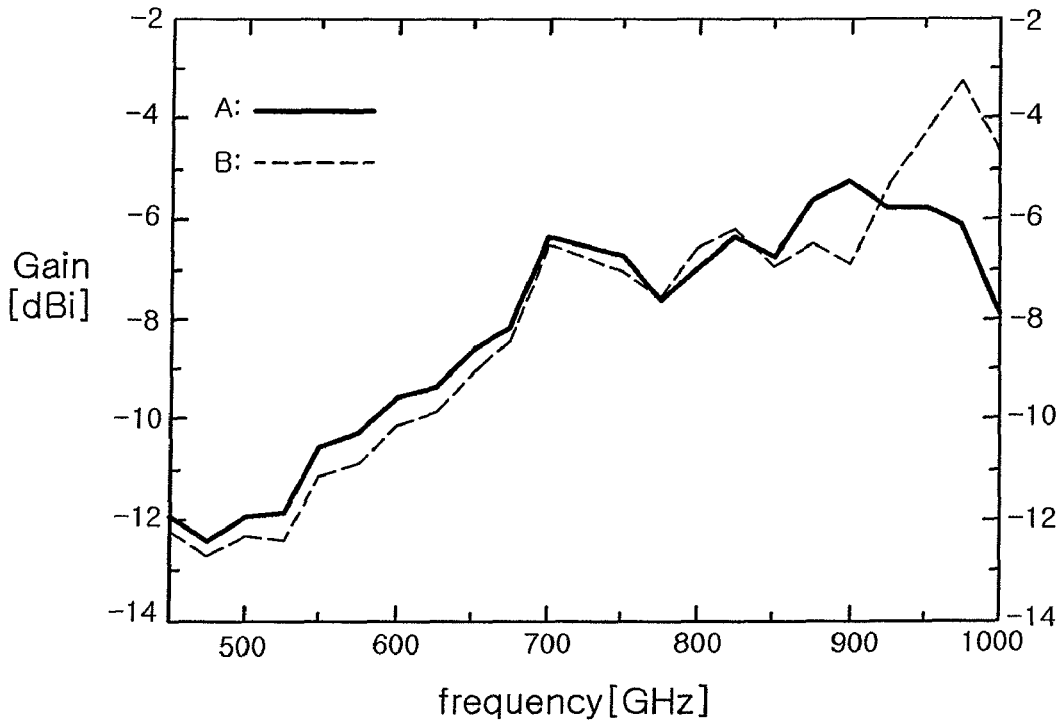

FIGS. 7A and 7B are graphs illustrating VSWRs and gains according to frequencies of antennas as shown in FIG. 4.

Here, two meander line radiators were employed, of which the underlying radiator had 3 turns and the overlying radiator had 10 turns. A dielectric substrate formed between the radiators adopted a magnetic dielectric material with a permittivity of 5.5 and a permeability of 1.2.

FIGS. 7A and 7B illustrate VSWRs and gains of the antenna A having a meander line radiator formed in a width of 2 mm and the antenna B having a meander line radiator formed in a width of 3 mm, respectively.

Referring to FIG. 7A, regardless of width, the two meander line radiators employed ensure a broader bandwidth than in a case where only one meander line radiator is employed.

Also, referring to FIG. 7B, the two meander line radiators enhance gain at a low frequency and a high frequency over a case where only one meander line radiator is employed as shown in FIG. 5B.

As shown, a greater width of the meander line radiator lowers a resonance frequency and increases gain at a low frequency bandwidth. Therefore, antenna characteristics can be tuned by adjusting the width of the meander line radiator.

As set forth above, according to exemplary embodiments of the invention, to produce a broadband antenna, a meander line radiator has bending portions formed at an acute angle and a stub extended from each of the bending portions. Antenna characteristics of the broadband antenna can be tuned by adjusting the number of turns and width of the meander line radiator, and permittivity and permeability of a dielectric substrate.

While the present invention has been shown and described in connection with the exemplary embodiments, it will be apparent to those skilled in the art that modifications and variations can be made without departing from the spirit and scope of the invention as defined by the appended claims.

What is claimed is:

1. A broadband antenna, comprising:

a dielectric substrate;

a meander line radiator formed on the dielectric substrate, the meander line radiator having at least one bent portion bent at an acute angle;

a stub extended from at least one of the bent portions of the meander line radiator to another bent portion of the meander line radiator;

a feeder disposed at an end of the meander line radiator; and at least one additional radiator connected to an identical feeder where the meander line radiator is connected, wherein the at least one additional radiator is a meander line radiator bent at an acute angle and having a stub extended from at least one of bent portions;

wherein the meander line radiator has 2n number of bent portions thereon forming an n number of turns, where $n \geqq 1$; and wherein the meander line radiator and the at least one additional radiator have a different number of turns from one another.

2. The broadband antenna according to claim 1, wherein the meander line radiator has two bent portions formed at an identical acute angle in each of the turns.

3. The broadband antenna according to claim 2, wherein at least one bent portion is bent at an angle different than another bent portion.

4. The broadband antenna according to claim 2, wherein the bent portions are formed at either increasing or decreasing angles with an increase in the number of the turns.

5. The broadband antenna according to claim 1, wherein each of the bent portions is formed at an identical acute angle.

6. The broadband antenna according to claim 1, further comprising a stub formed at the end of the meander line radiator.

7. The broadband antenna according to claim 1, wherein the bent portions have respective stubs extended therefrom and the stubs are oriented in an identical direction.

8. The broadband antenna according to claim 7, wherein the stubs are formed in parallel with a length direction of the meander line radiator.

9. The broadband antenna according to claim 1, further comprising a dielectric layer covering the meander line radiator.

10. The broadband antenna according to claim 1, wherein the dielectric substrate is formed of a composite material having a magnetic material and a polymer resin mixed together.

11. The broadband antenna according to claim 10, wherein the magnetic material is selected from one of carbonyl iron, nickel-zinc ferrite powder, and Z-type ferrite powder.

12. A broadband antenna, comprising;

a dielectric substrate;

a meander line radiator formed on the dielectric substrate, the meander line radiator having at least one bent portion bent at an acute angle;

a stub extended from at least one of the bent portions of the meander line radiator to another portion of the meander line radiator;

a dielectric layer covering the meander line radiator; and a feeder disposed at an end of the meander line radiator;

wherein the meander line radiator has 2n number of bent portions thereon forming an n number of turns, where $\geqq 1$.

13. The broadband antenna according to claim 12, wherein the meander line radiator has two bent portions formed at an identical acute angle in each of the turns.

14. The broadband antenna according to claim 13, wherein at least one bent portion is bent at an angle different than another bent portion.

15. The broadband antenna according to claim 12, wherein each of the bent portions is formed at an identical acute angle.

16. The broadband antenna according to claim 12, further comprising at least one additional radiator on the dielectric layer, wherein the at least one additional radiator connected to an identical feeder where the meander line radiator is connected.

17. The broadband antenna according to claim 16, wherein the at least one additional radiator is a meander line radiator bent at the acute angle and having a stub extended from at least one of bent portions.

18. The broadband antenna according to claim 17, wherein the meander line radiator and the at least one additional radiator have a different number of turns from one another.

19. The broadband antenna according to claim 12, wherein the dielectric substrate and the dielectric layer have permittivity and permeability different from one another.

* * * * *